US005410289A

United States Patent [19]

Futa

[11] Patent Number: 5,410,289

[45] Date of Patent: Apr. 25, 1995

[54] ELECTROMAGNET

[75] Inventor: David Futa, South Bend, Ind.

[73] Assignee: Delta Star Electric, Inc., South Bend, Ind.

[21] Appl. No.: 135,158

[22] Filed: Oct. 12, 1993

[51] Int. Cl.[6] ..... H01F 5/00; H01F 7/20; H01F 17/00; H01F 27/28

[52] U.S. Cl. ..... 335/299; 335/289; 335/291; 336/177; 336/223

[58] Field of Search ..... 335/299, 300, 285, 289, 335/291, 292, 294; 336/177, 223, 232

[56] References Cited

U.S. PATENT DOCUMENTS

| | | | |
|---|---|---|---|
| 1,334,504 | 2/1910 | Parker . | |
| 1,667,766 | 5/1928 | Bing . | |
| 2,761,094 | 8/1956 | Frampton . | |
| 2,787,874 | 4/1957 | Blood et al. . | |
| 2,882,458 | 4/1959 | Anderson et al. . | |
| 3,265,939 | 8/1966 | Rinderer . | |
| 3,521,209 | 7/1970 | Fritz . | |
| 3,559,130 | 1/1971 | Schrader | 335/216 |
| 3,763,453 | 10/1973 | Schurr . | |
| 3,984,796 | 10/1976 | Frampton . | |
| 4,264,887 | 4/1981 | Barrett . | |
| 5,003,126 | 3/1991 | Fujii | 174/36 |
| 5,264,981 | 11/1993 | Campbell | 360/126 |
| 5,312,674 | 5/1994 | Haertling | 428/210 |

FOREIGN PATENT DOCUMENTS

| | | | |
|---|---|---|---|
| 3-99408 | 4/1991 | Japan | 335/216 |

OTHER PUBLICATIONS

Catalog No. 6200D—Ding's Magnetic Group.

*Primary Examiner*—Leo P. Picard
*Assistant Examiner*—Stephen T. Ryan
*Attorney, Agent, or Firm*—Barnes & Thornburg

[57] ABSTRACT

An electromagnet is provided having a housing and a coil disposed therein. The coil comprises three strips of material placed adjacent one another in an interleaved fashion. The coil comprises a strip of insulation, a magnetic strip, and an electrical conductor strip. The magnetic strip extends radially for only a portion of the coil. The electrical conductor strip comprises two separate materials. In one embodiment, the electrical conductor strip comprises a segment of bare copper, and a segment of bare aluminum.

12 Claims, 2 Drawing Sheets

ELECTROMAGNET

BACKGROUND AND SUMMARY OF THE INVENTION

The present invention relates to electromagnets. More particularly, the present invention relates to coil arrangements for electromagnets.

Electromagnets can be used to lift and transfer heavy ferro-magnetic objects. The lifting power is created by creating a magnetic field. To create the magnetic field, the magnet includes a coil of interleaved, spiraling strips of various materials. The coil is electrically energized, creating the magnetic flux. An electromagnet with an interleaf coil is shown in U.S. Pat. No. 4,264,887.

The lifting strength of the magnet is a function, in part, of the number of turns in the coil. The ampere-turns (NI) of the magnet is a unit of measurement equaling the current running through the coil multiplied by the number of turns in the coil. The strength of the magnet may be increased by increasing the ampere-turns—by increasing the current and/or increasing the number of turns in the coil.

As the amperage in the coil is increased, the heat created by the coil also increases. Reducing the thickness of the conductor element in the coil increases the resistance to the flow of current, thereby increasing the heat generated by the coil within the reduced width conductor section. In general, the equation of power lost, or heat generated, is $I^2R$=power lost. In this equation, I=amperage and R=resistance. When either the amperage or the resistance is increased, the heat generated increases. Excessive heat can ruin the coil insulation and raise the coefficient of resistance, thereby making the magnet inoperable.

Therefore, it is an object of the present invention to provide an electromagnet which provides increased lifting power.

Another object of the present invention is to provide an electromagnet having a coil which generates a relatively low amount of heat when compared to the ampere-turns produced.

A still further object of the present invention is to provide an electromagnet which is able to effectively dissipate the heat generated by the coil.

These and other objects are attained in an electromagnet having a housing and coil positioned substantially within the housing. An external power supply is used to provide electrical power to the magnet.

The housing includes a yoke, having a hole in the center and a peripheral flange thereabout. The housing also includes a center pole shoe, having a post therein. The pole shoe is bonded to the yoke, with the post being inserted into the hole in the yoke. A circular nonmagnetic plate is positioned between the disk of the center pole shoe and the peripheral flange of the yoke. Thus, a space is created within the interior of the housing.

The coil is disposed within the space in the housing. The coil is wound about the post, and extends radially outward in an interleaved, spiraling fashion. The coil comprises three strips: an insulation strip, a ferro-magnetic strip and an electrical conductor strip. The insulation strip and the electrical conductor strip extend radially throughout the coil; the ferro-magnetic strip extends from the center of the coil a distance less than the radius of the coil. Thus, the coil can be described as comprising two portions, a first portion and a second portion. The first portion includes an interleaved arrangement of an insulator strip, a ferro-magnetic strip and an electrical conductor strip. The second portion comprises an interleaved spiral arrangement of an insulator strip and an electrical conductor strip.

The electrical conductor strip is made of two segments, having different chemical, physical and electrical properties. The two segments are bonded together, such as with rivets. An antioxidant may be used to coat the junction of the two dissimilar metals. In the embodiments shown, the first segment of the electrical conductor strip is made of bare copper, and the second segment of the electrical conductor strip is made of bare aluminum. The first segment of the electrical conductor strip extends radially throughout the first portion of the coil, and the second segment of the electrical conductor material extends radially throughout the second portion of the coil. The coil is held firmly within the housing by a resilient potting compound.

Other objects, advantages and novel features of the present invention will become apparent from the following description of the invention when considered in conjunction with the accompanying drawings.

DETAILED DESCRIPTION OF THE PREFERRED EMBODIMENTS

Figure 1:
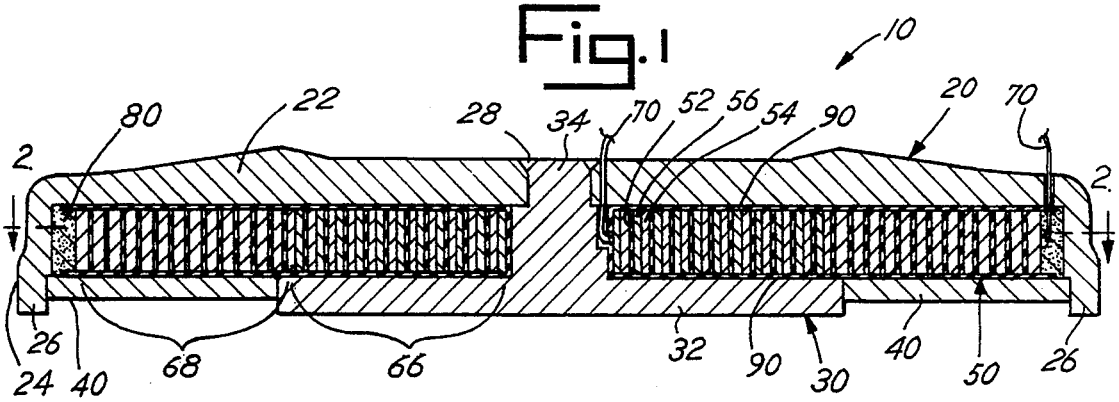
FIG. 1 is a side cut-away view of the electromagnet of the present invention.

An electromagnet 10 of the present invention typically includes housing 20 and coil 50 disposed therein. As shown, electromagnet 10 is designed to provide improved lifting capability and heat dissipating capability. By increasing the heat dissipation, electromagnet 10 is less conducive to wear and heat damage than other known magnets. As shown in FIG. 1, housing 20 includes yoke 22. Yoke 22 is a generally disk-shaped element, including peripheral flange 24 thereon. As shown, yoke 22 is generally circular in shape, but is not to be limited to this design. Peripheral flange 24 extends substantially transverse from the periphery of yoke 22. The distal portion of flange 24 is referred to as the outer pole shoe 26. In the approximate center of yoke 22 is hole 28.

Housing 20 also includes center pole shoe 30. Pole shoe 30 includes a generally circular disk 32 and post 34 extending substantially transverse from the approximate center of the disk. Center pole shoe 30 is connected to yoke 22 to form a unitary housing 20. Yoke 22 and center pole shoe 30 are positioned adjacent one another such that post 34 is substantially inserted into hole 28. Center pole shoe 30 is then connected or bonded to yoke 22. In the embodiments shown, pole shoe 30 is welded to yoke 22. However, other types of bonding arrangements may be used. Housing 20, formed of center pole shoe 30 and yoke 22, is typically made of a ferro-magnetic material, such as carbon steel.

Housing 20 also includes plate 40. Plate 40 is generally circular in shape, and has a large hole in its center. Plate 40 is connected or bonded to disk 32 and peripheral flange 24, thus completing housing 20. As shown, plate 40 is welded to disk 32 and peripheral flange 24.

Plate 40 is made of non-magnetic material, such as manganese, stainless steel, brass, or an equivalent.

Housing 20 defines a substantially circular space therein, substantially between yoke 22 and center pole shoe 30. Disposed within the space is coil 50. Coil 50 generates a magnetic flux, thus providing electromagnet 10 with its lifting capabilities. Coil 50 is a combination of strips of materials, placed adjacent one another in a spiraling, interleaved arrangement. Coil 50, as shown, is generally disk-shaped, having generally circular top and bottom surfaces. The top and bottom surfaces define a radius R and diameter D of the coil.

The number of turns in coil 50 governs, in part, the strength or lifting power of electromagnet 10. The figures which accompany this written specification show a representation of the arrangement of the strips which comprise coil 50. In practice, coil 50 may include approximately 2500 turns. Electromagnet 10 of the present invention, may, however, be effectively constructed having more or fewer turns.

Coil 50 is wound such that post 34 of center pole shoe 30 is the approximate center of the coil. Coil 50 extends radially outward from post 34 a distance R. This distance R is slightly less than the radial distance from post 34 to peripheral flange 24, thus leaving a small gap along the periphery of coil 50.

Coil 50 of the present invention includes three strips of material; insulator strip 52, magnetic strip 54 and electrical conductor strip 56. Each strip is a long, slender piece made from a suitable material. Insulator strip 52 may be made of any suitable electrical insulator, such as Nomex, manufactured by DuPont. Magnetic strip 54 is made of a ferro-magnetic material, such as electrical steel. In the embodiments shown, magnetic strip 54 is made of silicone electrical steel. The silicone provides the electrical steel with a low rate of hysteresis. The present invention is not limited, however, by the use of silicone electrical steel in the construction of magnetic strip 54. The third strip, electrical conductor strip 56, is made of an electrically conductive, non-magnetic material.

Electrical conductor strip 56 includes a first segment 58 and a second segment 60. First segment 58 extends for a portion of the length of electrical conductor strip 56, and second segment 60 extends for the remaining length of the strip. In the embodiments shown, first segment 58 is made of bare copper, and second segment 60 is made of bare aluminum. However, other materials may be substituted. One such suitable substitute is anodized aluminum. However, the anodization process can be expensive, and it is thus sometimes not cost efficient.

First segment 58 and second segment 60 are connected to one another, to combine to form electrical conductive strip 56. First segment 58 and second segment 60 may be connected in various methods, such as welding, or mechanical connectors. Another method is creating a swedge using a punch apparatus.

When two dissimilar metals are connected or bonded together, there is a risk of creating a reaction along the junction of the two metals. This risk may be increased when the metals are subject to relatively high temperatures, as may occur in coil 50. For example, when first segment 58 of electrical conductor strip 56 is copper, and second segment 60 is aluminum, there is a risk that the aluminum will oxidize at the junction of the dissimilar metals. An antioxidant agent may be used to inhibit this reaction.

Figure 3:
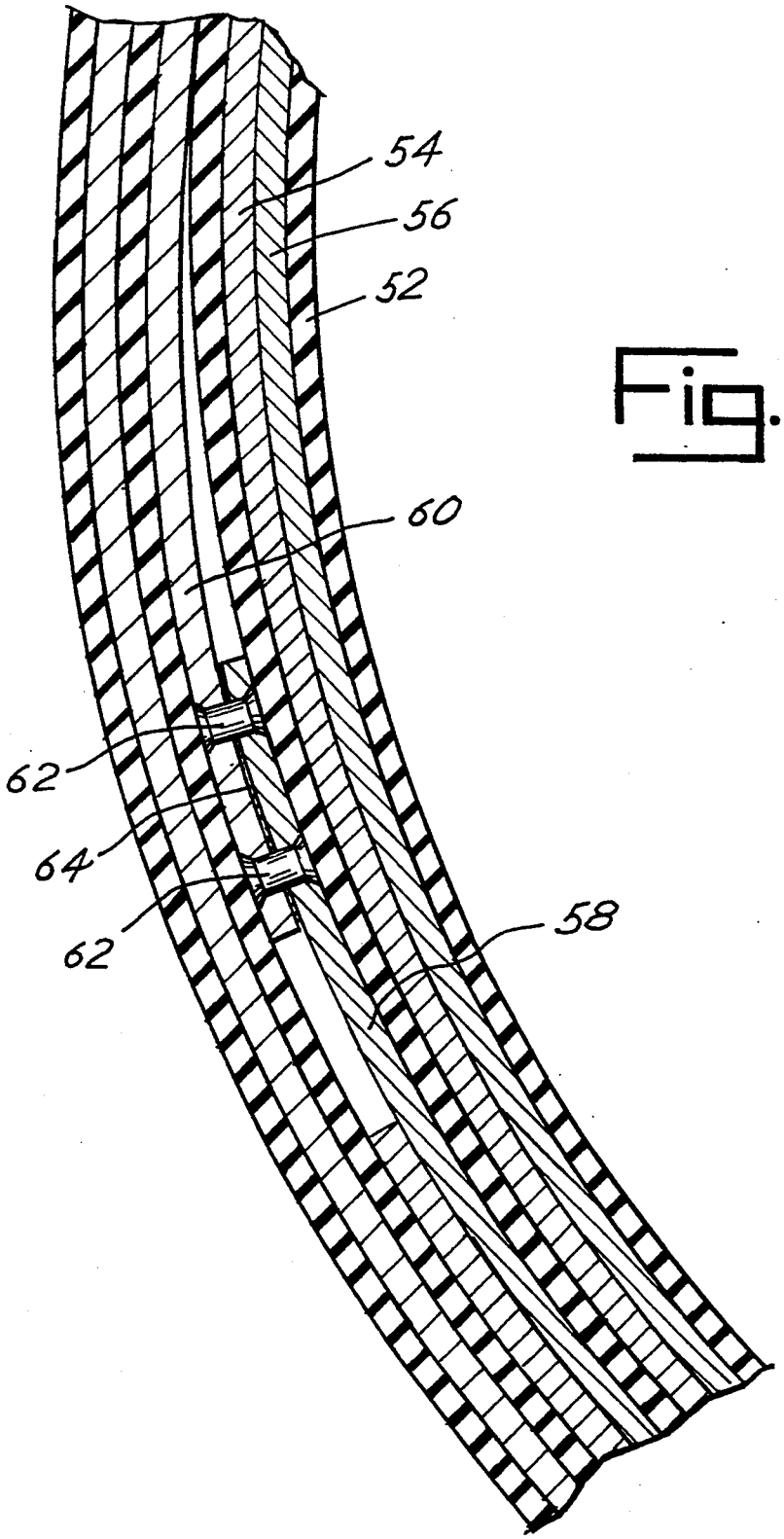
FIG. 3 shows the junction of the first and second segments of the electrical conductor strip of the coil of the electromagnet of the present invention.

As shown, first segment 58 and second segment 60 are connected using aluminum pop rivets 62 and antioxidant agent 64. One such antioxidant which is commercially available is sold as No-Locks. Antioxidant agent 64 is applied to the junction of first segment 58 and second segment 60. Pop rivets 62 are then used to connect one end of first segment 58 to an end of second segment 60. This can be seen in FIG. 3. Thus, electrical conductor strip 56 is a single, continuous strip.

Figure 2:
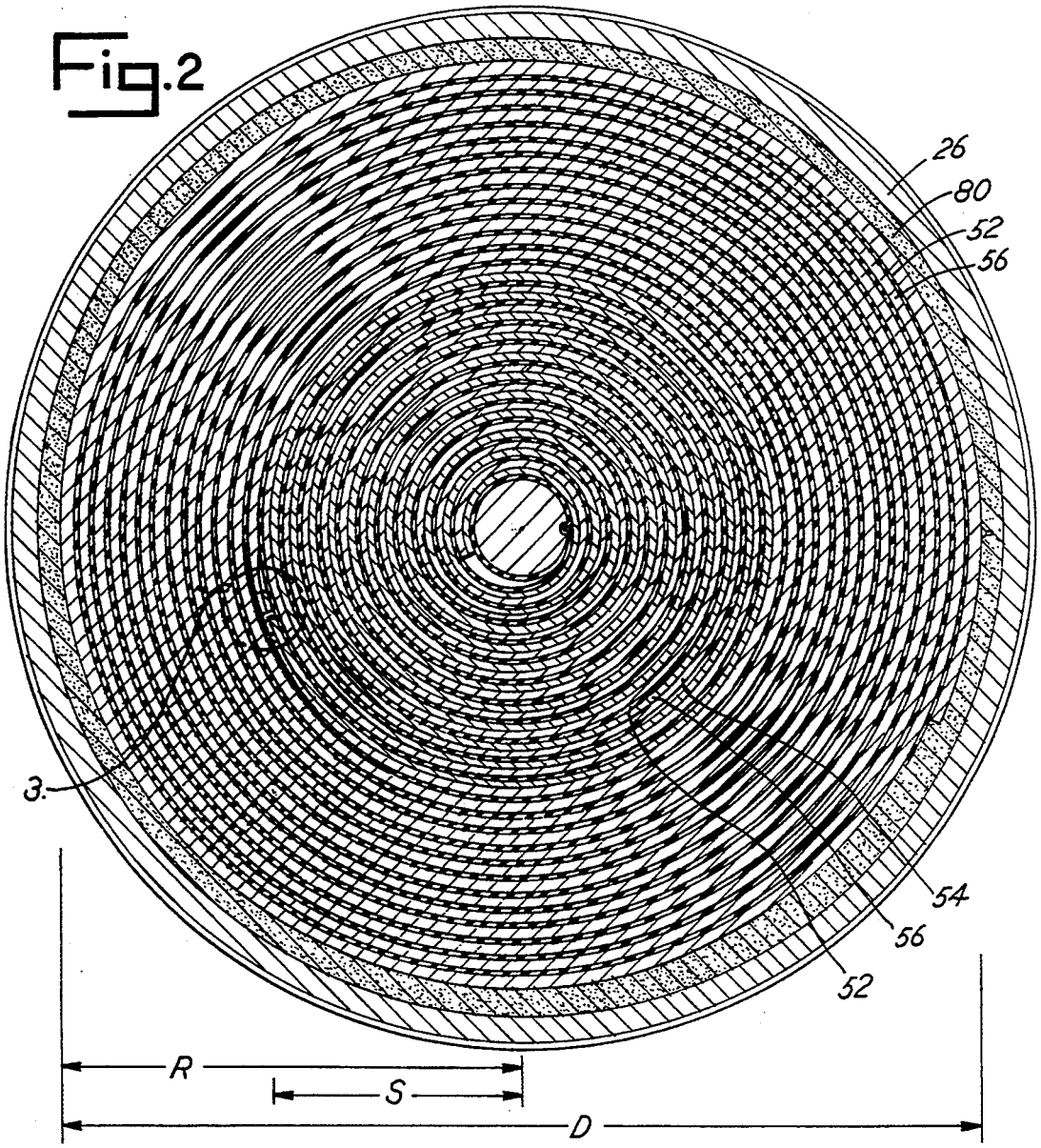
FIG. 2 is a bottom cut-away view of the electromagnet of the present invention, showing the interleaf arrangement of the coil.

The three strips of coil 50 are positioned in an interleaved fashion. This can be seen in FIG. 2. As shown, insulator strip 52 is wound about post 34. Electrical conductor strip 56 is then placed about insulator strip 52. Then, magnetic strip 54 is placed adjacent electrical conductor strip 56. The three strips are then spirally wound about one another. It should be understood by those skilled in the art that the relative positioning of electrical conductor strip 56 and magnetic strip 54 may be reversed. That is, the order of the strips extending radially from post 34 may be: insulator strip 52, magnetic strip 54, and electrical conductor strip 56.

The length of insulator strip 52 and electrical conductor strip 56 are approximately equal, and both extend radially from post 34 to the periphery of coil 50. Magnetic strip 54 is shorter than either insulator strip 52 or electrical conductor strip 56. Magnetic strip 54 extends radially from post 34 a distance which is less than the radius R of coil 50.

Thus, coil 50 comprises first portion 66 and second portion 68. First portion 66 includes an interleaved arrangement of insulator strip 52, ferro-magnetic strip 54 and electrical conductor strip 56, and extends radially from post 34 a distance S. Second portion 68 includes an interleaved arrangement of insulator strip 52 and electrical conductor strip 56. Second portion 68 extends radially from the radial extreme of first portion 66 to the periphery of coil 50, a distance of approximately R less S.

The use of a material having a relatively high conductivity in electrical conductor strip 56 of first portion 66 of coil 50 allows a thinner gauge of material to be used. This maintains the power consumption from the electric supply and the heat generated in first portion 66 of coil 50 at acceptable levels, while allowing an increase in the number of turns of electrical conductor strip 56 within first portion 66. This provides an increase in the ampere-turns of electromagnet 10, with the increase being focused in the center portion of the magnet, adjacent the area of center pole shoe 30. The increased flux is transmitted directly to the ferro-magnetic material being moved. This increases the overall performance of electromagnet 10 without an increase in power consumption or an increase in heat generated.

The thickness of magnetic strip 54 and conductor strip 56 in first portion 66 are approximately equivalent. As shown, the thickness of these two strips in this portion of coil 50 is approximately 0.018 inch. The thickness of electrical conductor strip 56 in second portion 68 is shown being approximately 0.028 inches thick. The thickness of insulator strip 52 is substantially constant throughout coil 50, and is approximately 0.003 inches thick.

In the embodiments shown, the radius of first portion 66 coincides with the radius of first segment 58 of electrical conductor strip 56. The radius of second portion 68 coincides with the radius of second segment 60 of electrical conductor strip 56. Thus, electrical conductor strip 56 of first portion 66 is made of copper, and the electrical conductor strip 56 in second portion 68 is made of aluminum. The junction of first segment 58 and second segment 60 occurs at the junction of first portion 66 and second portion 68.

An external power supply provides electrical current to electromagnet 10. Yoke 22 of housing 20 include a plurality of small holes therein (not shown), through which terminals are positioned. Terminal 70 is positioned through a hole in housing 20, near post 34. Terminal 70 is connected to electrical conductor strip 56 adjacent its innermost point. Terminal 72 is likewise positioned through an opening in housing 20, and is connected to electrical conductor strip 56 adjacent its outermost point. Both terminals are connected to a suitable source of electricity (not shown), allowing coil 50 to be electrically energized.

When electromagnet 10 is electrically energized, coil 50 creates a flux field. This provides electromagnet 10 with its lifting capability. The energizing of coil 50 also creates heat. As the heat increases, coil 50 expands. The present invention includes compound 80, disposed about the periphery of coil 50, between the coil and peripheral flange 24 of yoke 22. Compound 80 has a putty-like consistency, and provides shock absorption for coil 50, and snugly maintains the coil within housing 20. Compound 80 also aids in transferring heat to the periphery of yoke 24. The resiliency of compound 80 allows coil 50 to expand and contract. Compound 80 may be made of a resilient epoxy material, such as Epic, which is commercially available.

Electromagnet 10 also includes insulator disk 90 positioned substantially above and below coil 50, within housing 20. Insulator disk 90 is made of a suitable, electrically non-conductive, high dielectric insulating material.

Electromagnet 10 of a present invention has been shown and described having a single coil 50, comprising three strips of material. It should be well understood to those skilled in the art that electromagnet 10 could be made having multiple coils 50 stacked substantially vertically on one another, each being spaced by an insulator disk 90. For example, electromagnet 10 may have one, two, or more similar coils stacked on one another. While any number of coils may be utilized, it may be preferred to use a number of coils which is an even multiple of two.

The detail by which the present invention has been described is by way of illustration and example only and is not to be taken as a limitation of the present invention. The scope of the present invention is to be defined only by the terms of the appended claims.

What is claimed is:

1. An electromagnet, comprising:

a housing;

a coil positioned substantially within the housing;

means connected to the coil for supplying electric power to the coil;

wherein the coil includes a spiral, interleaved arrangement, the arrangement comprising a first strip of insulation, a second strip of ferro-magnetic material, and a third strip of an electrical conductor material wound together side by side; and wherein the strip of electrical conductor material comprises a first material extending for a segment of the length of the strip, and a second material extending for another segment of the strip.

2. The device according to claim 1 wherein said first material and said second material are mechanically bonded together.

3. The device according to claim 2 wherein said bond includes a plurality of rivets.

4. The device according to claim 1, wherein said coil defines a substantially circular surface, said surface defining a radius and a diameter.

5. The device according to claim 4 wherein said first material extends a distance less than the radius of said circle, and said second material extends from the end of said first material to the radial extreme of the circle.

6. The device according to claim 1 wherein said first material is copper.

7. The device according to claim 1 wherein said second material is aluminum.

8. The device according to claim 1 wherein said second strip of ferro-magnetic material extends spirally from the approximate center of said coil a distance less than the radius of the coil.

9. The device according to claim 1, including a compound positioned substantially between said coil and said housing.

10. The device according to claim 9 wherein said compound comprises an epoxy.

11. A coil for an electromagnet, comprising:

a first strip of insulation;

a second strip of ferro-magnetic material;

a third strip of electrical conductor material, the third strip including a first segment made of a material having a first set of chemical properties, and a second segment made of a material having a second set of chemical properties; and wherein the first, second and third strips are layered in an interleaved arrangement wound together side by side.

12. A coil for an electromagnet, said coil defining a radius, comprising:

a first radial portion having an interleaved arrangement including a first strip of insulator, a second strip of ferro-magnetic material and a third strip of wound together side by side; and a second radial portion having an interleaved arrangement of only a first strip of insulator and a second strip of electrical conductor material, wherein said electrical conductor material in said first radial portion has chemical properties different from the electrical conductor material of said second radial portion.

* * * * *